US008876567B2

(12) United States Patent
LeBlanc

(10) Patent No.: US 8,876,567 B2
(45) Date of Patent: Nov. 4, 2014

(54) DROP-KNEE BOARD

(71) Applicant: Lester LeBlanc, Larchmont, NY (US)

(72) Inventor: Lester LeBlanc, Larchmont, NY (US)

( * ) Notice: Subject to any disclaimer, the term of this patent is extended or adjusted under 35 U.S.C. 154(b) by 107 days.

(21) Appl. No.: 13/717,067

(22) Filed: Dec. 17, 2012

(65) Prior Publication Data

US 2013/0178122 A1 Jul. 11, 2013

Related U.S. Application Data

(63) Continuation-in-part of application No. 13/226,996, filed on Sep. 7, 2011, now abandoned, which is a continuation-in-part of application No. 12/589,821, filed on Oct. 30, 2009, now abandoned.

(51) Int. Cl.
*B63B 35/79* (2006.01)

(52) U.S. Cl.
CPC ..... *B63B 35/7906* (2013.01); *B63B 35/7926* (2013.01)
USPC ..... 441/74; D21/769

(58) Field of Classification Search
CPC ..... B63B 35/79; B63B 35/7916
USPC ..... 441/65, 73, 74
See application file for complete search history.

(56) References Cited

U.S. PATENT DOCUMENTS

| | | | | | |
|---|---|---|---|---|---|
| D55,079 | S | * | 5/1920 | Ranlett | D21/770 |
| 2,389,729 | A | * | 11/1945 | Howland | 441/74 |
| 2,685,696 | A | * | 8/1954 | Oscanyan | 441/74 |
| 4,405,139 | A | * | 9/1983 | Kawahard | 280/14.24 |
| D334,419 | S | * | 3/1993 | Klein | D21/769 |
| 6,059,621 | A | * | 5/2000 | Vogel | 441/74 |
| 6,656,005 | B2 | * | 12/2003 | Meyerhoffer | 441/65 |
| D607,525 | S | * | 1/2010 | Marciano | D21/769 |
| 2010/0273372 | A1 | * | 10/2010 | Parsia | 441/74 |
| 2012/0115378 | A1 | * | 5/2012 | Strover et al. | 441/74 |

FOREIGN PATENT DOCUMENTS

| | | | | |
|---|---|---|---|---|
| WO | WO 9211181 | A1 * | 7/1992 | B63B 35/79 |

* cited by examiner

*Primary Examiner* — Stephen Avila
*Assistant Examiner* — Andrew Polay
(74) *Attorney, Agent, or Firm* — Evelyn M. Sommer

(57) ABSTRACT

The present invention describes a versatile multi-purpose board having a fore section and an aft section suitable for wave boarding. The multi-purpose board of the present invention is provided with an aft section having crotch-sized width in order to allow a user's legs to kick within a general lateral outline of a wider fore section. The combination board can be utilized for surfboarding (both legs standing), drop-knee boarding (one leg standing and one knee down) or body boarding (body prone), in any sequence without the rider having to alter the board.

8 Claims, 2 Drawing Sheets

DROP-KNEE BOARD

CROSS-REFERENCE TO RELATED APPLICATION

This application is a continuation-in-part of pending application Ser. No. 13/226,996, filed Sep. 7, 2011, which is in turn a continuation-in-part of application Ser. No. 12/589,821, filed Oct. 30, 2009 and now abandoned.

FIELD OF THE INVENTION

This invention relates to a combination body board which can be used by the user for surfboarding, drop-knee boarding and body boarding, and more particularly to a body board, with an added narrowed tail section for straddling by its user. The body board of the present invention having an added tail section can be ridden as a body board but also allows for the rider to rise from a prone position to an erect position, or with the hind leg's knee down on the board and the front leg in the standing position knee boarding, or completely standing as on a surfboard. The body board's tail section lessens drag and thereby allows for faster hydroplaning for catching waves, being more competitive in the lineup, and moves more easily through the surf breakwater. The drop-knee board is preferably used with swim fins on the feet.

The invention herein provides an elongated aft section to add length to a body board in order to improve a body board's top speed by increasing its surface area lengthwise, i.e., increasing the float capacity and to provide a place for the rear knee/foot to stand.

The applicant's invention is directed to a board having a fore section and an aft section that incorporates the essential features of a body board in the fore section and a "water ski/surfboard" surfboard in the aft section, the fore section acts as a forward torso section and has a lateral outline which is substantially chest size, the aft section, acting as the standing section, is a narrower, crotch size, extended piece resembling a portion of a "water ski/surfboard" surfboard. The aft section, because of its dimensions, can be straddled if desired.

The body board allows the rider to switch from the prone position (as in riding a body board) to the standing-up position (as in riding a surfboard) and vice versa without changing the board, allowing for greater skill development and for a different experience. The board also allows for an intermediate position of a forward leg standing while the hind leg's knee rests on the aft section of the board.

The aft section can be formed as an integral piece of the combination board or as a separate piece from the forward torso section. When separate pieces are used, they can be made to readily snap into one piece allowing the rider to choose either boarding format before or in between rides. The separate pieces may also be attached by a flexible joint, thereby increasing the board's ability to turn in the water. The fore and aft sections are both simple structures and not like the complicated multipart fully shaped surfboards boards of the art which have to have the parts thereof adjusted, rearranged, deleted, added to depending on the wave conditions, the riders skill and the use of the board at the time with inadequate space for efficient kicking of the legs as in a fully shaped surfboard.

As used herein, the term "drop-knee board" is intended to mean a body board having an added narrowed tail section which permits a rider to ride as on a body board in a prone position and to rise to a standing position and ride as on a surf board or with the hind leg's knee on the board and the front leg in the standing position or drop knee boarding. The narrowed tail section is dimensioned so as to provide a place for the knee and shin of the hind leg.

As used herein, the term surf board is intended to mean a board which permits a rider to ride with both legs standing.

As used herein, the term body board is intended to mean a board which permits a rider to ride with the body in the prone position.

As used herein, the term drop-knee board is intended to mean a board where the aft section of the board generally begins mid-body or where the legs hang off the end of the fore section, providing an elongated aft section to add length to a body board in order to improve a body board's top speed by increasing its surface area lengthwise and for increasing the float capacity to provide a place for the rear knee/foot to stand.

As used herein, "aft" means an extension of the fore section coupled to the fore section. The aft section is in the rear, after or back of the fore section.

BACKGROUND OF THE INVENTION

Conventional body boards and surfboards are two distinct types of devices used in water sports such as riding ocean waves.

Body boards are flotation amusement devices for riding waves. They are similar to surfboards, with the major differences being that body boards are shorter, lighter and generally more flexible than surfboards. In form, a body board is a contoured, elongated, foam plank having a plastic bottom skin, which is generally slick and shiny to enhance planing on the surf, and a top riding surface of foam or plastic.

Body boards are traditionally ridden in a prone or procumbent position, with an arm extending forwardly for gripping the nose end of the board and the other arm positioned in a trailing manner for gripping a side edge. In this position, the rider can push or pull against the front or side edges, bending or twisting the board to assist the board in maneuvering. Although the rider's legs create considerable drag, slowing the board's potential speed, they can help with steering and maneuvering. Further, the fore and aft sections may have a split rail construction as known in the art of body boarding and surfboarding so as to create a rocker out of a flat board Body boarding is particularly favored by inexperienced riders as it is relatively easy to learn and is most popular among those who don't want to invest the time or money required to learn other methods, such as surfboarding.

The more advanced form of surfing is stand-up surfboarding done on a long, narrow and somewhat rounded board known as a surfboard. It offers a challenge to the surfer who must manipulate, maneuver and stabilize the relatively large board while standing on it even in steep or tight turns with the waves crashing around the surfer.

Traditionally, body boarding and stand-up surfing require separate boards and consequently the rider incurs two separate costs when his interest and experience shift. A rider interested in participating in both activities in one setting is required to carry two separate boards.

BACKGROUND ART

U.S. Pat. No. 7,121,909 (Myerhoffer) discloses a board and more particularly a system of components that can be assembled, disassembled and reassembled to form various types of boards. A key factor is the board's performance characteristics. Performance characteristics affect how the board handles in the water and can vary widely from board to board. Although each board has its own performance characteristics, no single set of characteristics is ideal, since the surfing will be performed in a variety of situations, from different surf conditions to different rider skills and preferences.

One option is to buy several different surfboards, each with different performance characteristics. Then, different boards could be used at different times. This approach has many drawbacks. First of all, buying one surfboard can be expensive, let alone buying several. Also, this approach requires that several surfboards be brought along if the surf conditions are unknown. Thus, if the weather is highly variable or if the surfing will be done at some point in the future, several boards will have to be brought along just in case.

Myerhoffer's invention is therefore a system of interchangeable components. What the patent teaches is a system of interchangeable components that can be assembled, disassembled, and re-assembled to form various surfboards with different performance characteristics. Such a system, if it could be realized, would be more affordable, more portable, and more useful than a collection of several surfboards. As hereinafter noted, the multipart, complicated assemblage components gives rise to problems, water leakage, difficulty in assemblage, decomposition of the board when hazard surface conditions are realized, time and space to accomplish changes, etc.

U.S. Pat. No. 6,718,897 (DeBello) teaches surf boards and body boards having a structure on its bottom surface that reduces wet surface area and increases speed that will add additional lift, that will in turn allow the surfboard to plane sooner and to produce thrust when turning that will accelerate forward movement. The foregoing is accomplished by providing stepped bottom surfaces of the board and due to the shapes that are provided of the bottom surfaces of the step members.

In U.S. Pat. No. 7,347,756 (Candler), there is presented a surfboard that incorporates a plurality of channeled through-apertures at the tail end of the surfboard. By allowing water to pass through these apertures, the tail of the is at least partially submerged; thus, the tail of the surfboard acts as a skag and presents a significantly different feel to making turns on a surfboard. At least one skag is used and preferably the channeled apertures are angled with the bottom opening of the aperture forward of the top opening of the aperture, such that the apertures act as scoops to channel water from underneath the surfboard through the aperture and out over the tail end of the top surface of the surfboard. This arrangement is claimed to enable the surfer to achieve greater maneuverability and higher turns and cut backs.

There is a need for a wave-boarding device that can be used for both surfboarding and body boarding by the rider, allowing for progress in skill development.

In the surfing culture, the person up first on the wave has the right to ride the wave alone. Surfboards, being longer, move faster and consequently they are found furthest away from the shore allowing a great advantage in the choice of waves. Body boarders, in contrast generally wait closest to the shore and have the least choices of waves. Therefore, surfboarders have a competitive advantage over body boarders in the so-called lineup. For example, when a good wave is coming in, a long surf board may have taken it, limiting the body boarder's opportunities, even more so if there are many other surfboards riding the waves.

Riding a surfboard is not without disadvantages. In addition to requiring a higher level of skills to ride, a surfboard, typically 7 feet in length or greater, may be too difficult to paddle through the breakwater in heavy ocean conditions such as when wave heights reach approximately 6 feet in beach break areas. Under this condition, smaller boards such as conventional body boards, despite the relatively slower paddling ability associated therewith, are easier to get behind the breakwater due to less drag on the board by the breakwater and it is possible to duck them under the white water rush.

Therefore, there exists a need for a multipurpose board that can be used either as a surfboard or as a body board depending on the location, the wave conditions, and/or the experience and skills of the riders.

SUMMARY OF THE INVENTION

The present invention addresses the shortcomings of the separate surfboards and body board designs discussed above by presenting a combination board that incorporates the essential features of a body board in the fore section and a surfboard in the aft section. The fore section, acting as a forward torso section, has a lateral outline which is substantially chest size. The aft section, acting as the standing section, is a narrower, crotch size, extended piece resembling a portion of a surfboard. This unique crotch-sized section can be straddled, allowing the legs to kick more effectively than if the chest section continued to the tail end.

When the wave condition is more preferable for body boarding or simply when the rider desires so doing, the rider can ride the combination board in a manner as if riding a body board. The rider's chest and torso rest prone on the top surface of the forward torso section. In this case, the rider can straddle the extended aft section and the rider's legs are allowed to kick within the general outline of the forward torso section. The combination board when ridden as a body board has an improved ability in getting through the breakwater.

The aft section allows the rider in the prone position to get his legs out of the water and onto the top of the tail section. The body board ridden in this way hydroplanes faster than an ordinary body board for catching waves and for getting a competitive advantage in the lineup.

The body board allows the rider to switch from the prone position (as in riding a body board) to the standing-up position (as in riding a surfboard) and vice versa without changing the board, allowing for greater skill development and for a different experience. The board also allows for an intermediate position of a forward leg standing while the hind leg's knee rests on the aft section of the board.

The rider's swim fins preferably can be used with the body board, allowing the board to move easily in getting through the breakwater and be more competitive in catching waves. The swim fins are also safety devices which aid the rider in swimming to shore when the board has been lost in heavy surf. Swim fins also greatly increase the ability to catch waves by increasing the speed of the board.

The aft section can be formed as an integral piece of the combination board or as a separate piece from the forward torso section. When separate pieces are used, they can be made to readily snap into one piece allowing the rider to choose either boarding format before or in between rides. The separate pieces may also be attached by a flexible joint, thereby increasing the board's ability to turn in the water. The joining may be carried out using the conventional materials and techniques.

BRIEF DESCRIPTION OF THE INVENTION

The foregoing aspects and other features of the present invention are explained in the following description, taken in connection with the accompanying drawings, wherein.

DETAILED DESCRIPTION OF THE INVENTION

Figure 2:
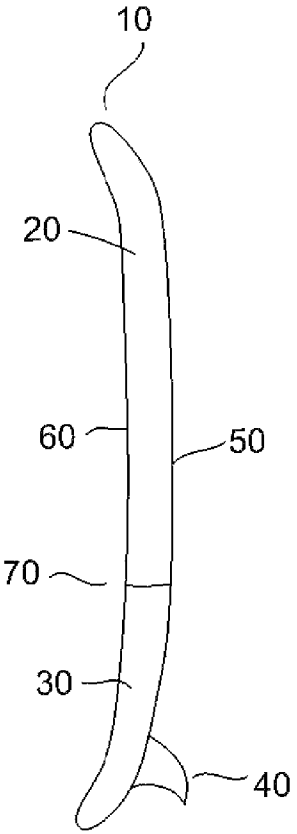
FIG. 2 is a right side view of the preferred embodiment of the invention depicted in FIG. 1.

Reference will now be made in detail to embodiments of the invention that are illustrated in the accompanying drawings. Wherever possible, same or similar reference numerals are used in the drawings and the description to refer to the same or like parts or steps. The drawings are in simplified form and are not to precise scale. For purposes of convenience and clarity only, directional terms, such as top, bottom, up, down, over, above, below, left, and right may be used with respect to the drawings. These and similar directional terms should not be construed to limit the scope of the invention in any manner. The words "connect," "couple," and similar terms with their inflectional morphemes do not necessarily denote direct and immediate connections, but also include connections through mediate elements or devices.

Figure 1:
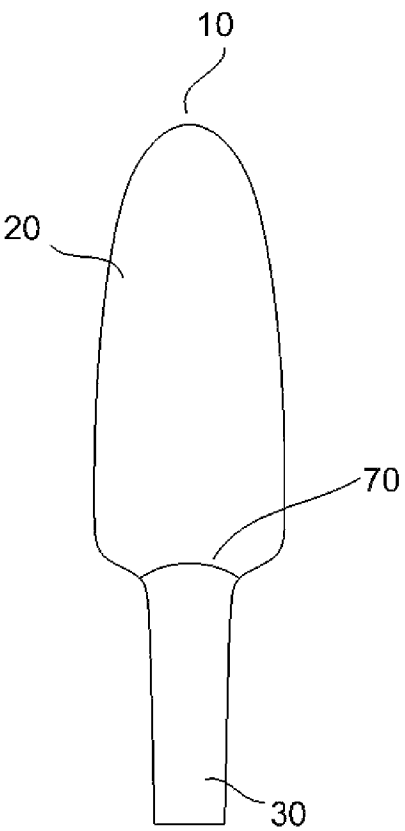
FIG. 1 is a front view of a preferred embodiment of the invention.
Figure 4:
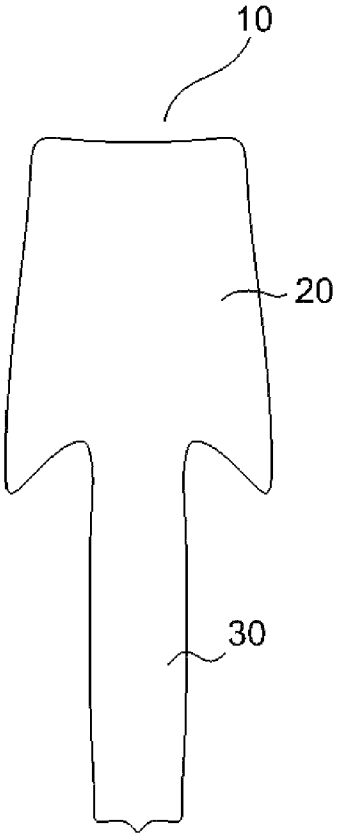
FIG. 4 is a front view of still another embodiment of the drop-knee board of the invention.
Figure 3:
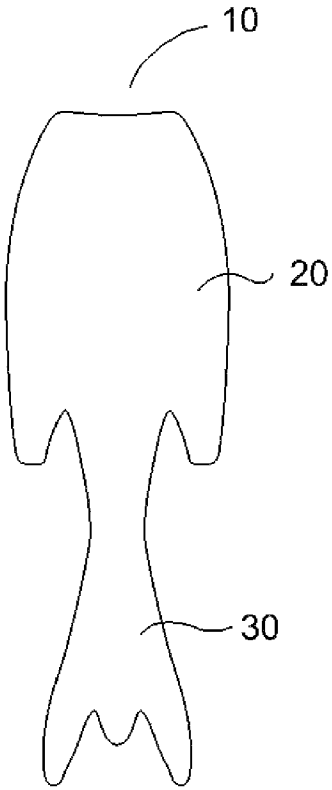
FIG. 3 is a front view of another embodiment of the invention.

Referring to the drawings, FIG. 1 in particular, there is shown a body board of the present invention 10 comprising a fore section 20 and an aft section 30. Although the length and various dimensions of the body board of the present invention may vary, in a contemplated design, the combination surfboard-body board preferably has an overall length approximately between 5-8 feet long. Fore section 20 preferably has a width of approximately between 18-28 inches at its widest point. Aft section 30 preferably has a width of approximately between 1-9 inches and is 2.5-4.5 inches thick. Preferably, the aft section 30 has length of 1-6 feet.

Accordingly, the dimensions of the subject body board apparatus may vary in conformance to user as well as manufacturing preferences.

The width of fore section 20 generally complements the width of the torso of a user.

The width of aft section 30 is a matter of comfort and preference by a user. Aft section 30 is contemplated to be used as the standing section. This section, which is narrower than the fore section 20, is approximately crotch size, and is straddled, allowing the legs to kick more effectively than if the width of fore section 20 continued to aft section 30. Thus, one inventive aspect of the present invention is that the width of aft section 30 allows the user's legs to kick within the general lateral outline of the width of fore section 20. In the case of a surfboard, although a user is also able to straddle and kick, the user's legs create drag and thus slow movement as the legs fall outside the lateral outline of the fore section of the surfboard.

Referring to FIG. 2, board 10 further comprises a removable fin 40. Fin 40 may be permanently attached to underside 50 of board 10. Preferably, fin 40 may be attachable and detachable from underside 50. It is also possible for there to be multiple fins; for example, it is possible to have three fins, a tail fin 40, and two side fins, or the tail fin may be eliminated, leaving only the two side fins (not shown).

Although board 10 of the present invention may be constructed of various materials, it is contemplated that board 10 is constructed by an injection molding process having a core of polyurethane foam approximately 2-4 inches thick. Bottom portion 50 preferably has a coating of approximately 1/16 inch fiberglass, whereas top portion 60 has two coats of approximately 1/8 inch fiberglass. Preferably, aft section 30 can be formed as an integral piece of board 10 or as a separate piece from fore section 20. When separate pieces are used, they can be made to readily snap into one piece at junction 70, by any means known in the prior art, allowing the rider to choose either boarding format before or in between rides. Included among the methods used to couple, snap into one piece the fore section 20 and the aft section 30 are groove and tongue, dove tail, loop and snap, and hinge arrangements. The loop arrangement, for example, allows for removably connecting the aft section 30 to the fore section 20 and allows for quickly changing the characteristic of the board. The loops are located within recesses on the edge of the fore section 20. Screws or plugs extend from the lower surface of the aft section through the loops to hold the two sections firmly in place. The screws or plug heads are recessed flush with the lower surface of the board. In alternative embodiments, the fore and aft sections are separable and secured by snaps, screws, glue, tongue and groove, dove tail, hinge or other conventional arrangements. The fore and aft sections can also be coupled together at a flexible junction.

Today, most modern surfboards are made of polyurethane foam (PU), with one or more wooden strips or "stringers", fiberglass cloth, and polyester resin (PE). Other board materials include epoxy resin and Expanded Polystyrene foam (EPS) which is stronger and lighter than traditional PU/PE construction. Newer designs incorporate materials such as carbon fiber and variable-flex composites in conjunction with fiberglass and epoxy or polyester resins.

Since epoxy/EPS surfboards are generally lighter, they will float better than a traditional PU/PE board of similar size, shape and thickness. This makes them easier to paddle and faster in the water. However, a common complaint of EPS boards is that they do not provide as much feedback as a traditional PU/PE board. For this reason, many advanced surfers prefer that their surfboards be made from traditional materials.

The joints formed by the coupling are of varying degrees of stiffness and vary in this respect from rigid to loose. Varying the stiffness lets the sections bend, increasing the turning movement.

When the wave condition is more preferable for body boarding or simply when the rider desires so doing, the rider can ride board 10 in a manner as if riding a body board. The rider's chest and torso rest prone on the top surface of the forward torso section. In this case, the rider can straddle the extended aft section and the rider's legs are allowed to kick within the general outline of the forward torso section. The user's swim fins preferably can be used with board 10, allowing the user to move easily in getting through the breakwater and be more competitive in catching waves. The swim fins are also safety devices which aid the rider in swimming to shore when the board has been lost in heavy surf. Board 10 ridden as a body board has an improved ability in getting through the breakwater and catching waves.

Aft section 30 allows the user to get his legs out of the water, while in the prone position. Board 10 ridden in this way hydroplanes faster than an ordinary body board for catching waves and for getting a competitive advantage in the lineup. It is understood that when the user is wearing swim fins, standing on the board is not as easy as standing without them, but there are techniques for doing this and the fins are essential for getting through the breakwater and for making a short board go faster for catching waves. One such technique is known as the "drop-knee technique."

Thus, board 10 allows the user to switch from the prone position (as in riding a body board) to the standing-up position (as in riding a surfboard) or an intermediate position of a forward leg standing while the knee of the hind leg rests on the aft section of the board, and vice versa without changing the board, allowing for greater skill development and for a different experience.

Another unexpected result from the elongated, narrow aft section is that it tracks well when the underside fin is removed. Ordinarily, the removable fin keeps the tail end from sliding out. However, when the fin is removed, a very loose ride results because the elongated tail keeps the board controllable. The finless ride is a lot like driving a car in the snow.

Still another unexpected result is the finding that there is an intermediate way of surfing in between body boarding and surfing. The board provides a way to surf that is not body boarding or surfing. It is new and called "drop-knee boarding", resulting from a board made specifically to accommodate the hind leg/shin to solidly rest on the board. Presently, the technique of substituting drop-knee boarding for body boarding exists, but refers to use with swim fins. However, the body board has size limitations. An increase in size in accordance with the invention makes it easier to get up and provides space to accommodate the swim fins so that they do not drag in the water.

From the foregoing specification and discussion, it is appreciated that the present invention presents a unique combination surfboard-body board 10. It follows that the same has substantial utility inasmuch as the same can be used for both surfing and body boarding without having to utilize two different boards.

The subject method of wave boarding includes the steps of: a.) providing a wave board device suitable for conveying a wave boarding user to a first user selected aquatic wave boarding position wherein the wave boarding device is a body board having a fore section; an aft section coupled to the fore section, the fore section having a width substantially wider than a width of the aft section and wherein the width of the aft section is about 1 to 9 inches thereby permitting the user's legs to kick within a lateral outline of the width of the wider fore section when the user is in the prone position; b.) self-propelling the wave boarding user to the first selected wave boarding position; and c.) wave boarding the device by the user in any of a prone, kneeling or standing upright posture, or with one leg in the standing position and with the knee of the second leg resting on the board's aft section, from the first user selected aquatic wave boarding position to a second, further aquatic position.

The fore section 20 can also incorporate after-market functional parts that are now common in the art such as rubber grip mats for the back foot, or hand holds for one or both hands. They can also carry graphics and logos of the manufacturer, for example, by way of embossed or debossed graphics.

The fore section 20 may incorporate a split rail design that allows a flat board to have a rocker or spoon shape only on its rail.

As in the case of boards on the mark today, the boards of the invention contain one, two or three rods (usually of carbon or graphite), referred to as stringers, to strengthen the board, reduce deformation, add stiffness and recoil to the core, thus providing greater speed off bottom turns and transitions on the wave. If a single stringer is used, it is placed in the center of the board running parallel to the rails. If two are used, they are placed symmetrically about the y-axis. Triple stringers are a combination of the placement of both a single and double stringer. Additionally, if present, deck, rails and bottom are bonded via various hot air lamination techniques to the core. Previous to the lamination technique, shapers accomplished this by using glue.

It should be appreciated that modifications and alterations obvious to those skilled in the art are not to be considered as beyond the scope of the present invention. For example, the specific switching and biasing arrangements depicted in the drawings may be substituted with equivalent devices. Accordingly, the present invention is intended to embrace all such alternatives, modifications and variances which fall within the scope of the appended claims.

What is claimed is:

1. A combination body board consisting essentially of:

a. a fore section;

b. an aft section being an extension of the fore section and coupled to the fore section, the aft section being narrower than the fore section, wherein said aft section is of consistent width throughout;

c. the fore section having a width of about 18 to 28 inches at its widest point, the aft section having a width of about 1 to 6 inches, the board having a combined length of the fore section and aft section of between about 4 and 9 feet, the aft section having a length of about 3 to 6 feet;

d. wherein the lateral outline of the fore section decreases in size from about 18 to about 28 inches to the aft section's width of about 1 to about 6 inches over a distance of about 0 to 12 inches;

e. wherein the fore section and the aft section are separate pieces coupled together at a junction.

2. The board of claim 1 wherein the width of the aft section is about 4 inches to 6 inches.

3. The board of claim 1 wherein at least one removable fin is attached to the underside of the board.

4. The board of claim 3 wherein said fin is a tail fin and is a slide-in fin.

5. The board of claim 1 having a core of polyurethane coated over with fiberglass.

6. The board of claim 1 wherein said board is suitable for surf boarding with both legs standing.

7. The board of claim 1 wherein said board is suitable for drop-knee boarding with one leg standing and one knee down.

8. The board of claim 1 wherein said board is suitable for body boarding with the body in the prone position.

* * * * *